United States Patent [19]

Nelson

[11] Patent Number: 4,924,275

[45] Date of Patent: May 8, 1990

[54] PRINTER SWITCHABLE BETWEEN DUPLEX AND SIMPLEX MODE ON A PAGE BY PAGE BASIS

[75] Inventor: Thomas C. Nelson, Melbourne, Fla.

[73] Assignee: Storage Technology Corporation, Louisville, Colo.

[21] Appl. No.: 351,429

[22] Filed: May 12, 1989

[51] Int. Cl.[5] ..... B41J 13/00

[52] U.S. Cl. ..... 355/319; 271/291; 271/301; 400/624

[58] Field of Search ..... 400/188, 624; 101/296, 101/230, 231; 271/301, 291, 65; 355/319

[56] References Cited

U.S. PATENT DOCUMENTS 4,272,181 6/1981 Treseder ..... 355/319

*Primary Examiner*—Clifford D. Crowder

*Attorney, Agent, or Firm*—Dorr, Carson, Sloan & Peterson

[57] ABSTRACT

The printer switchable between simplex and duplex mode of operation on a page by page basis makes use of a single simplex print engine. Duplex printing is accomplished by the reinsertion of a simplex printed page into the input of the print engine in a flipped mode so the other side of the printed page can be printed by the print engine. This printer also includes apparatus that dynamically switches the operation of the printer from duplex to simplex mode of operation when the printing commands input from the associated processor indicates that the other side of a simplex printed page is a blank page. This enables the print engine to eject the simplex printed page directly to the output paper bin without having to cycle this simplex printed page back through the print engine even though there are no characters to be printed thereon. This blank page suppression or simplex/duplex mode switching thereby increases the throughput of this printer system by avoiding the unnecessary delays occasioned by cycling a page of paper through the print engine when nothing is to printed thereon.

22 Claims, 2 Drawing Sheets

PRINTER SWITCHABLE BETWEEN DUPLEX AND SIMPLEX MODE ON A PAGE BY PAGE BASIS

FIELD OF THE INVENTION

This invention relates to printers and, in particular, to a printing system that can be dynamically switched between duplex and simplex mode of operation on a page by page basis.

PROBLEM

It is a problem in the field of printing systems to dynamically switch between simplex and duplex mode of operation. Non-impact printing systems typically make use of a single simplex print engine to accomplish duplex printing. The simplex print engine has an input for receiving blank pages of paper and an output for ejecting pages that have been printed by the print engine. The print characters along with overlays and segments are downloaded from an associated processor that is equipped with a print driver. The processor transmits print data signals via the print driver to the non-impact printing system. A print controller located in the non-impact printing system converts this print data into control signals for the print engine and the associated paper handling apparatus to thereby imprint the characters on the page of paper as designated by the print data received from the associated processor. To achieve duplex printing using a single simplex print engine, the print engine prints one side of the page of paper and then ejects this page via its output. The ejected page is then flipped and reinserted into the input of the print engine such that the print engine can now print the successive page of characters on the previously unused side of the page of paper. In this fashion, a single simplex print engine can perform a duplex printing function.

A significant disadvantage of this architecture is that every page of paper must be cycled through the print engine twice in order to achieve the duplex printing. This halves the printing throughput of the print engine since it must handle the same page of paper twice before the page is finally printed. A further delay is occasioned by the additional time required to receive the simplex printed page of paper output by the print engine, flip this printed page and then reinsert it into the input of the print engine. During the time that this simplex printed page of paper is being flipped and reinserted into the print engine, the print engine is idle. Therefore, this simple and economical architecture suffers a speed disadvantage in having to cycle every page of paper through the print engine twice with the delay occasioned in this additional paper handling as mentioned. This is especially counterproductive when the second side of a page does not contain any printing thereon but still must be cycled through the print engine in order to maintain the proper sequencing and formatting of the document that is being printed.

SOLUTION

The above described problems are solved and technical advance achieved in the field by the printer of the present invention that is dynamically switchable between simplex and duplex mode of operation on a page by page basis. This printer makes use of the basic single simplex print engine architecture and accomplishes duplex printing by the reinsertion of a simplex printed page into the input of the print engine in a flipped mode so the other side of the printed page can be printed by the print engine. This printer also includes apparatus that dynamically switches the operation of the printer from duplex to simplex mode when the printing commands input from the associated processor indicates that the other side of a simplex printed page is a blank page. This enables the print engine to eject the simplex printed page directly to the output paper bin without having to cycle this simplex printed page back through the print engine even though there are no characters to be printed thereon. This blank page suppression or simplex/duplex mode switching thereby increases the throughput of this printer system by avoiding the unnecessary delays occasioned by cycling a page of paper through the print engine when nothing is to be printed thereon.

DETAILED DESCRIPTION

Non-impact printing systems typically make use of a single simplex print engine to accomplish duplex printing. The simplex print engine has an input for receiving blank pages of paper and an output for ejecting pages that have been printed by the print engine. The print characters along with overlays and segments are downloaded from an associated processor that is equipped with a print driver. The processor transmits print data signals via the print driver to the non-impact printing system. A print controller located in the non-impact printing system converts this print data into control signals for the print engine and the associated paper handling apparatus to thereby imprint the characters on the page of paper as designated by the print data received from the associated processor. To achieve duplex printing using a single simplex print engine, the print engine prints one side of the page of paper and then ejects this page via its output. The ejected page is then flipped and reinserted into the input of the print engine such that the print engine can now print the successive page of characters on the previously unused side of the page of paper. In this fashion, a single simplex print engine can perform a duplex printing function.

The printer of the present invention is dynamically switchable between simplex and duplex mode of operation on a page by page basis. This printer includes apparatus that dynamically switches the operation of the printer from duplex to simplex mode when the printing input commands from the associated processor indicates that the other side of a simplex printed page is a blank page. This enables the print engine to eject the simplex printed page directly to the output paper bin without having to cycle this simplex printed page back through the print engine even though there are no characters to be printed thereon. This blank page suppression or simplex/duplex mode switching thereby increases the throughput of this printer system by avoiding the unnecessary delays occasioned by cycling a page of paper through the print engine when nothing is to be printed thereon.

System Architecture

Figure 1:
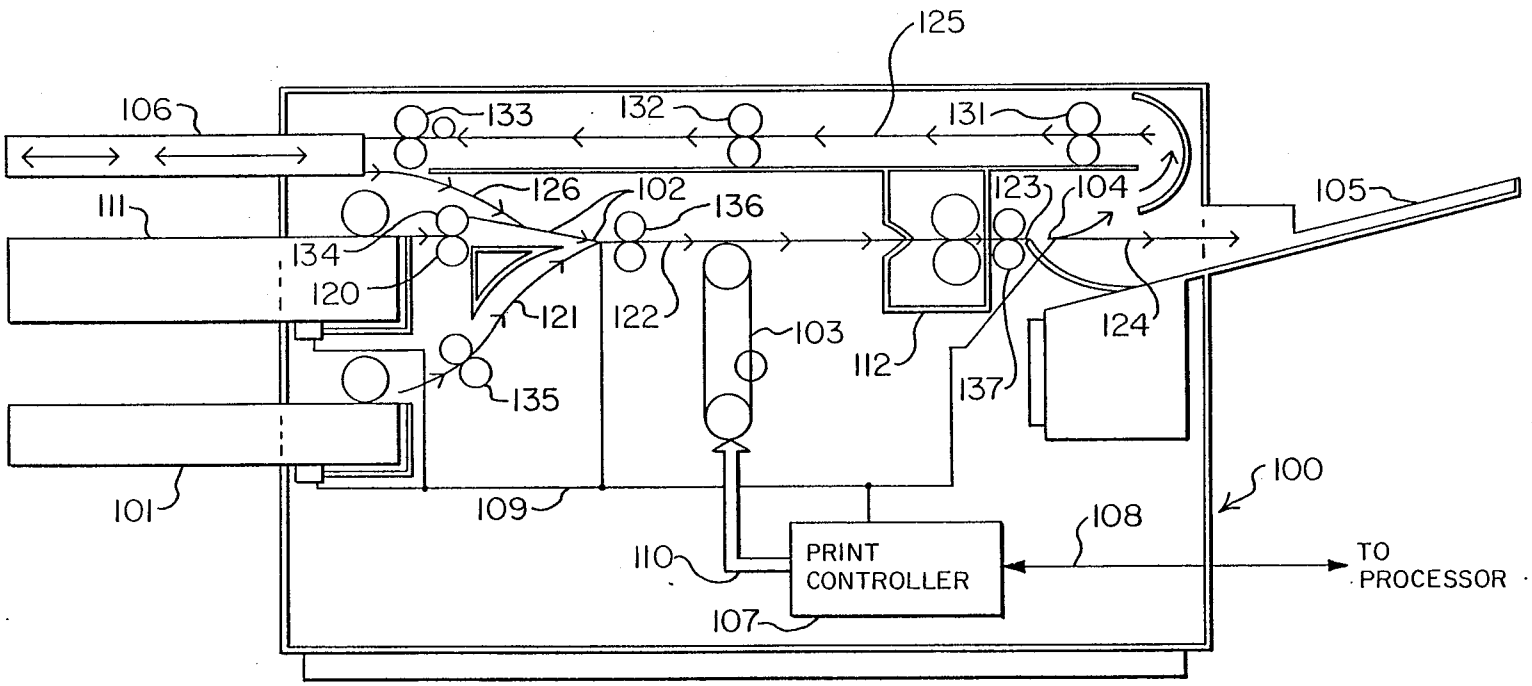
FIG. 1 illustrates the basic architecture of the subject printer in block diagram form.

FIG. 1 illustrates in block diagram form the basic architecture of the printer of the present invention. The exact mechanical details of each of the elements illustrated in FIG. 1 are not shown since these are well known in the art and need not be explained herein for an understanding of the present invention. Each of the mechanical devices included in this printer are schematically illustrated on FIG. 1.

This printer 100 is equipped with a single simplex print engine 103 that receives individual sheets of paper from a paper supply 101 or 111 via a paper feed path 121, 122 or 120, 122 respectively. Once a sheet of paper has been input into simplex print engine 103 via one of these paper paths (ex—121, 122), the print characters are applied to the sheet of paper by simplex print engine 103 in well known fashion. The print characters are provided by an associated processor (not shown) which downloads the print data and printer commands on a page by page basis via data channel 108 to print controller 107, which typically consists of a processor and appropriate memory as is well known in the art. Print controller 107 converts the print data and printer commands received from the associated processor into the appropriate control signals that are used to activate the mechanical apparatus included in printer 100 as well as the electronics in simplex print engine 103 to convert the print data and printer commands received from the associated processor into physical representations on the sheet of paper via the print mechanism of simplex print engine 103. Once a sheet of paper has been printed by simplex print engine 103, it is ejected via paper path 123, 124 into output bin 105 where it is stored for retrieval by the user.

In the case where the printing is in a duplex mode, printer 100 prints side 2 of the sheet of paper first, then prints side 1. This is accomplished when the simplex printed page (side 2) ejected by simplex print engine 103 is inverted by flipper 104 and switched to paper path 125 where it is fed to a duplex holding tray 106. Duplex holding tray 106 is a device that refeeds the simplex printed sheet of paper such that it is applied via paper feed path 126 and switching device 102 and paper feed path 122 to the input of simplex print engine 103 such that the unprinted side of the simplex printed sheet of paper is not juxtaposed to the printing surface of the simplex print engine 103. Simplex print engine 103 as described above prints the successive page of printing onto this other side (side 1) of the sheet of paper and ejects the now duplex printed paper via paper path 123, switching device 104 and paper feed path 124 to output bin 105 where it is stored for retrieval by the user. Print controller 107 controls the operation of switching elements 102, 104 and paper supply 101, 111 via control leads 109 as is schematically illustrated in FIG. 1. This above described duplex printing is well known in the art and found in a number of commercially available printers.

Control of Standard Duplex Printing operation

Figure 2:
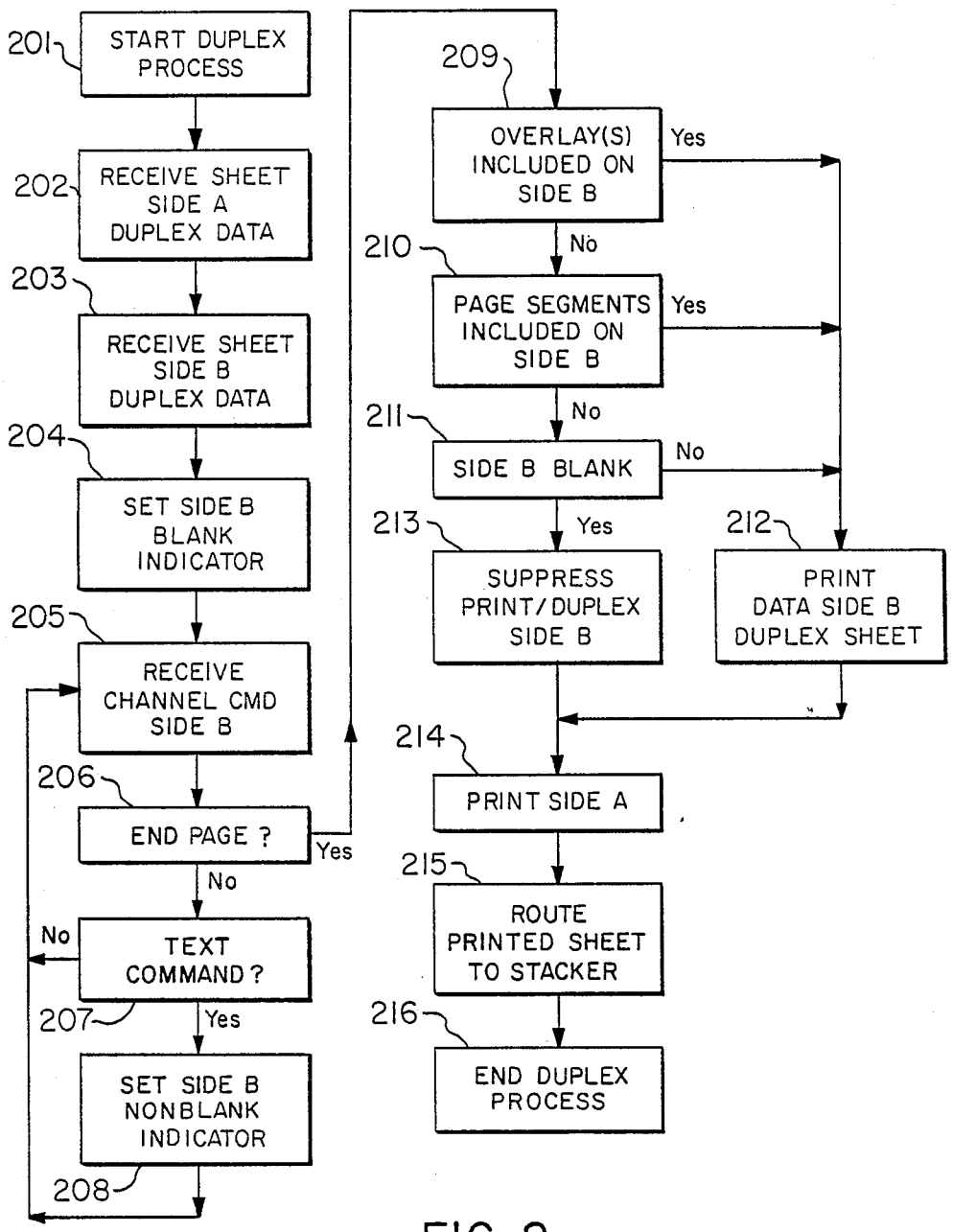
FIG. 2 illustrates in flow diagram form the operational steps taken by the control apparatus in this printer system.

The control apparatus that dynamically switches on a page by page basis between simplex and duplex mode of operation is illustrated in flow diagram form in FIG. 2. This control apparatus resides typically as software in print controller 107 and is used to control the above described well known elements in printer 100. In order to understand the operation of this control apparatus, a typical standard duplex printing operation is described with respect to the architecture of FIG. 1 and the operational steps listed in FIG. 2. At step 201, print controller 107 is activated to begin the duplex printing process. At steps 202, 203 print controller 107 receives side A and side B print data and printer commands via data channel 108 from the associated processor. This print data and printer commands at the beginning of a print job includes page setup, font definition and format data that is well known in the art. This initial information defines the basic form, format and style of the document that is to be printed. This control information is converted in well known fashion by print controller 107 into the appropriate control signals to regulate the operation of the hardware illustrated in FIG. 1. This includes selecting the desired size of paper from the appropriate one of paper supply trays 101, 111 as well as the orientation of the printing, whether standard format or landscape format. The simplex print engine 103 may be capable of producing printing in various type fonts and this typically is defined in the initial print setup information transmitted by the associated processor at the beginning of a print job.

Once this initial setup phase has been completed, the associated processor transmits a succession of sequentially ordered pages of print data on a page by page basis to print controller 107 via data channel 108. Once print data representative of an entire printed page, side A, is received by print controller 107 from the associated processor, at step 202 in FIG. 2, print controller 107 advances to step 203 where it receives printed data representative of an entire printed page, side B. As part of this step of receiving duplex data representative of side B of the printed page, print controller 107 analyses the received printing commands to determine the nature of the material if any that is to be printed on side B of the printed page.

At step 204, print controller 107 sets a flag in memory indicative of a blank side B of the printed page. At step 205, print controller 107 receives channel command information from the associated processor for side B of the printed page. Print controller 107 responds to the received channel command, advances to step 206 to determine whether the received signals are indicative of the end of the page. If not, processing advances to step 207 where print controller 107 determines whether the received channel command is a text command. If the received channel command is a text command, print controller 107 advances to step 208 where the data flag indicative of a blank page is reset to indicate that side B of the printed page is not a blank page. In this situation, processing returns to step 205 where print controller 107 awaits the receipt of the next channel command. If on the other hand, at step 207, print controller 107 determines that the received channel command is not a text command, then processing returns to step 205 where print controller 107 awaits the receipt of another channel command. The cycling through steps 205 through 208 continues until print controller 107 receives a channel command that is indicative of the end of side B of the printed page. At step 206, print controller 107 determines that the received channel command is an end of page command and processing then branches to step 209 where the content of the received set of channel commands indicative of the content of side B of the printed page are analyzed.

Selective Suppression of Duplex Mode

At step 209, print controller 107 analyzes the received set of channel commands to determine whether side B of the printed page is a blank page. At step 209, print controller 107 determines whether the received channel commands include a channel command indicative of an overlay included on side B of the printed page. If an overlay is included in the received channel commands, processing advances to step 212 where print controller 107 activates simplex print engine 103 to print the data received for side B of the print page on the sheet of paper that is received from paper supply 101 via paper feed path 121, 122. If, on the other hand, no overlays are included in the received set of channel commands, processing advances to step 210 where print controller 107 analyzes the received channel commands to determine whether any page segments are included on side B of the printed page. As above with step 209, if a page segment is included in the received set of channel commands, processing advances to set 212 where the side B of the printed page is printed. On the other hand, if no page segments are included in the received set of channel commands at step 210, processing advances to step 211 where print controller 107 makes the final determination of whether side B of the printed page is blank. This determination is accomplished by print controller 107 reading the data flag indicative of the blank/non-blank status of side B of the printed page that is set at either step 204 or 208. If, at step 211, print controller 107 determines that this flag has been set at step 208 to a non-blank indicator status, processing advances to step 212 where print controller 107 activates simplex print engine 103 to print side B of the printed page. On the other hand, if print controller 107 determines at step 211 that the data flag set at step 204 is indicative of a blank page and no overlays or page segments are included in the set of received channel commands as determined at step 209, 210 respectively, print controller 107 determines that side B of the printed page is indeed blank. Processing then advances to step 213 where the printing of side B of the printed page is suppressed. This is accomplished by print controller 107 activating paper supply 101 via control leads 109 to output a sheet of paper via feed path 121, 122 to simplex print engine 103. Print controller 107 transmits print data via bus 110 to simplex print engine 103 to print side A of the printed page of step 214. The now simplex printed page is output by print engine to fuser 112 where side A of the printed page is fused. The simplex printed page is then output via paper feed path 123 to switch element 104 which is activated by print controller 107 over control leads 109 to route the printed sheet of paper at step 215 to the paper output tray 105. Processing then advances to step 216 which is the end of the duplex printing process.

If, at step 212, print controller 107 activates the printing process to print side B of the printed page, this is accomplished by print controller 107 activating paper supply 101 via control lead 109 to output a sheet of appropriate size paper onto paper feed path 121. Print controller 107 activates switch element 102 to enable the sheet of paper output by paper supply 101 on paper feed path 121 to be transferred to the input of simplex print engine 103 via paper feed path 122. Print controller 107 transfers data indicative of the printing to be applied to side B of the printed page via bus 110 to simplex print engine 103. Simplex print engine 103 applies the printing to side B of the printed page in well known fashion and the now simplex printed sheet of paper is output by simplex print engine 103 to fuser 112 which functions to permanently affix the printing to side B of the simplex printed page. The now simplex printed page is output by fuser 112 via paper feed path 123 to switch element 104. Print controller 107 advances to step 214 to begin the printing of side A of the printed page. This is accomplished by print controller 107 activating switch 104 via control leads 109 which functions as a paper flipper to invert the simplex printed page of paper so that the blank side of this simplex page of paper is applied to the print surface of print engine 103. Switch 104 applies the simplex printed page via return path 125 to duplex holding tray 106. Included in return path 125 are rollers 131, 132 and 133 that function to transport the simplex printed page to duplex holding tray 106. Print controller 107 transfers the simplex printed page from duplex holding tray 106 via paper feed path 126 and switch element 102 to the input paper feed path 122 of simplex print engine 103 Rollers 136 feed the simplex printed page at the appropriate printing speed to simplex print engine 103 where at step 214 side A of this simplex printed page is now printed. This is accomplished by print controller 107 transmitting print data indicative of the content of side A via bus 110 to simplex print engine 103 which converts the received data into printing that is applied in well known fashion to side A of the simplex printed page. Once the printing is applied to the simplex printed page, this page is output to fuser 112 where side A is now fused to permanently affix the printing that was applied thereto by simplex print engine 103 to the page of paper. The fused printed page is output via paper feed path 123 to switch element 104. At step 215, print controller 107 activates switch element 104 via control leads 109 to route the duplex printed sheet of paper to the paper output bin 105 via paper feed path 124. At step 216, duplex printing process is terminated.

This blank page suppression operation is accomplished on a page by page basis by print controller 107. Thus, print controller 107 can dynamically switch the operation of printer 100 from duplex to simplex mode on a page by page basis by simply analyzing the printing commands received from the associated processor. Every simplex printed page that contains no printed information on the reverse or other side is simply routed directly to the output bin 105 rather than cycling through the return path that consists of switch element 104, duplex holding tray 106 and switch element 102 as was done in previous systems. This enables simplex print engine 103 to handle only pages of paper that require printing thereon. The blank pages are simply routed to the output bin 105 without having to be cycled through the simplex print engine 103 for no useful purpose. This not only minimizes the wear and tear on the mechanism of simplex print engine 103, paper return path 125 and duplex holding tray 106 but also constitutes a significant time savings since the cycle time of a piece of paper through this return path and print engine when no printing occurs is a significant waste of time.

Thus, the printer having the capability to dynamically switch from duplex to simplex mode on a page by page basis provides a significant time and mechanical wear advantage over the existing printing systems. This apparatus makes use of existing printer mechanisms to provide improved performance by the analysis of the content of the printing commands received from the associated processor to determine the routing of a simplex printed page of paper on a dynamic page by page basis.

While a specific embodiment of this invention has been disclosed, it is expected that those skilled in the art and will design alternate embodiments of this invention that fall within the scope of the appended claims.

I claim:

1. In a printer system, connected to an associated processor that transmits print command signals to said printer system, and having a single simplex print engine with an input for receiving a page of paper to be printed on one side and an output for ejecting a page of paper that said print engine has printed on one side, apparatus for selectively printing in the duplex mode on a page by page basis comprising:

means for returning, in a flipped mode, said printed page of paper ejected by said print engine to said input of said print engine for printing on the other side of said printed page of paper;

means for receiving a printed page of paper ejected by said print engine;

means for selectively routing said printed page of paper ejected by said print engine to said returning means or said receiving means, as a function of whether or not, respectively, said other side of said page of paper is to receive print, including:

means responsive to said print command signals received from said associated processor for detecting the presence of said print command signals indicative of a blank other side of said page of paper;

means responsive to said detected blank page for activating said receiving means.

2. The apparatus of claim 1 wherein said returning means includes:

means for flipping said printed page of paper received from said output of said print engine.

3. The apparatus of claim 2 wherein said returning means further includes:

means for applying said flipped printed page of paper to said input of said print engine.

4. The apparatus of claim 1 wherein said selectively routing means further includes:

means responsive to said detecting means detecting the presence of printing command signals indicative of a printed other side of said page of paper for activating said returning means.

5. In a printer system apparatus, connected to an associated processor that transmits print command signals to said printer system, for selectively printing in a duplex mode comprising:

simplex print engine having an input and an output for printing on one side of a page;

means for receiving printed pages output by said simplex print engine;

means connected to said input and said output for switching between printing in a simplex mode and a duplex mode on a page by page basis, including:

means responsive to printing command signals received from an associated processor for detecting the presence of printing command signals indicative of a blank other side of said page of paper;

means responsive to said detected blank page for activating said receiving means.

6. The apparatus of claim 5 wherein said switching means includes:

means for flipping a printed page output by said simplex print engine;

means for diverting a printed page output by said simplex print engine to said flipping means;

means for applying said flipped printed page to said input of said simplex print engine to enable said simplex print engine to print the other side of said printed page.

7. The apparatus of claim 6 further including:

means for enabling said diverting means only when said printed page output by said simplex print engine is printed on one side and the subsequent page contains printing.

8. The apparatus of claim 5 wherein said switching means further includes:

means responsive to said detecting means detecting the presence of printing command signals indicative of a printed other side of said page of paper for activating said returning means.

9. In a printer system controlled by an associated processor:

print engine having an input and an output for printing on one side of a page of paper in response to print signals received from said processor;

means for returning said page of paper to said input of said print engine when only one side of said page of paper is printed;

means responsive to said received print signals that are indicative of a blank page for disabling said returning means.

10. The apparatus of claim 9 wherein said returning means includes:

means for flipping a printed page of paper output by said print engine;

means for diverting a printed page of paper output by said print engine to said flipping means;

means for applying said flipped printed page of paper to said input of said print engine to enable said print engine to print the other side of said printed page of paper.

11. The apparatus of claim 10 further including:

means for enabling said diverting means only when said printed page of paper output by said print engine is printed on one side and the subsequent page contains printing.

12. The apparatus of claim 9 further including:

means for receiving printed pages of paper output by said print engine.

13. In a printer system apparatus, connected to an associated processor that transmits print command signals to said printer system, for selectively printing in a duplex mode comprising:

simplex print engine having an input and an output for printing on one side of a page;

means connected to said input and said output for switching between printing in a simplex mode and a duplex mode on a page by page basis, including:

means for flipping a printed page output by said simplex print engine;

means for diverting a printed page output by said simplex print engine to said flipping means;

means for applying said flipped printed page to said input of said simplex print engine to enable said simplex print engine to print the other side of said printed page;

means for enabling said diverting means only when said printed page output by said simplex print engine is printed on one side and said received print command signals indicate that the subsequent page contains printing;

means for receiving printed pages output by said simplex print engine.

14. In a printer system, connected to an associated processor that transmits print command signals to said printer system, and having a single simplex print engine with an input for receiving a page of paper to be printed on one side, an output for ejecting paper that said print engine has printed on one side and a paper bin for receiving paper printed by said print engine, a method of selectively printing in the duplex mode on a page by page basis comprising the steps of:

returning, in a flipped mode, said printed page of paper ejected by said print engine to said input of said print engine for printing on the other side of said printed page of paper;

receiving in said paper bin a printed page of paper ejected by said print engine;

selectively routing said printed page of paper ejected by said print engine to said input of said print engine or said paper bin, as a function of whether or not, respectively, said other side of said page of paper is to receive print, including:

detecting, in response to print signals received from an associated processor, the presence of print signals indicative of a blank other side of said page of paper;

activating, in response to said detected blank page, said step of receiving.

15. The method of claim 14 wherein said step of returning includes the step of:

flipping said printed page of paper received from said output of said print engine.

16. The method of claim 15 wherein said step of returning further includes the step of:

applying said flipped printed paper to said input of said print engine.

17. The method of claim 14 wherein said step of selectively routing further includes the step of:

activating, in response to detecting the presence of print signals indicative of a printed other side of said page of paper said step of returning.

18. In a printer system having a single simplex print engine with an input for receiving a page of paper to be printed on one side, an output for ejecting paper that said print engine has printed on one side and a paper bin for receiving paper printed by said print engine, a method of selectively printing in the duplex mode on a page by page basis comprising the steps of:

returning in a flipped mode said printed page of paper ejected by said print engine to said input of said print engine for printing on the other side of said printed page of paper, including the steps of:

flipping said printed page of paper received from said output of said print engine, applying said flipped printed paper to said input of said print engine;

receiving in said paper bin a printed page of paper ejected by said print engine;

selectively routing said printed page of paper ejected by said print engine to said input of said print engine or said paper bin, as a function of whether or not respectively, said other side of said page of paper is to receive print, including the steps detecting, in response to print signals received from an associated processor, the presence of print signals indicative of a blank other side of said page of paper, activating, in response to said detected blank page, said step of receiving, activating, in response to detecting the presence of print signals indicative of a printed other side of said page of paper said step of returning.

19. In a printer system, controlled by a processor that transmits print signals to said printer system, and having a print engine for printing on one side of a page of paper in response to print signals received from said processor, a method of selectively printing in a duplex mode comprising the steps of:

returning said page of paper to the input of said print engine when only one side of said page of paper is printed;

disabling, in response to said received print signals that are indicative of a blank page, said step of returning.

20. The method of claim 19 wherein said step of returning includes the step of:

flipping with a paper flipper, a printed page output by said simplex print engine;

diverting a printed page output by said simplex print engine to said paper flipper;

applying said flipped printed page to said input of said simplex print engine to enable said simplex print engine to print the other side of said printed page.

21. The method of claim 19 further including the step of:

enabling said step of diverting only when said printed page output by said simplex print engine is printed on one side and the subsequent page contains printing.

22. The method of claim 19 further including the step of:

receiving printed pages output by said simplex print engine.

* * * * *